United States Patent [19]

Kinoshita

[11] Patent Number: 4,929,529

[45] Date of Patent: May 29, 1990

[54] METHOD OF INCREASING SENSITIVITY OF DIGITAL PHOTOSENSITIVE MEMBER

[76] Inventor: Koichi Kinoshita, 34-13, Nishi-Kusabuka-Cho, Shizuoka-Shi, Shizuoka-Ken, Japan

[21] Appl. No.: 260,601

[22] Filed: Oct. 20, 1988

[30] Foreign Application Priority Data

Dec. 26, 1987 [JP] Japan ..... 62-331308

[51] Int. Cl.[5] ..... G03G 5/02

[52] U.S. Cl. ..... 430/127; 430/135; 430/945; 355/229

[58] Field of Search ..... 430/127, 30, 945, 54, 430/135; 355/220

[56] References Cited

U.S. PATENT DOCUMENTS 3,963,488 6/1976 Brushenko ..... 430/54

*Primary Examiner*—J. David Welsh

*Attorney, Agent, or Firm*—Marmorek, Guttman & Rubenstein

[57] ABSTRACT

In a method of increasing the sensitivity of a photosensitive member for inputting digital light, the photosensitive member is prepared to have a steep variation in the value of $\gamma$ of a latent image formed on the photosensitive member. Digital light and another light are applied to the photosensitive member at substantially the same time. The other light is emitted by an incandescent light, a LED or a fluorescent lamp.

21 Claims, 1 Drawing Sheet

METHOD OF INCREASING SENSITIVITY OF DIGITAL PHOTOSENSITIVE MEMBER

BACKGROUND OF THE INVENTION

This invention relates to a method of increasing the sensitivity of a photosensitive member for inputting digitally controlled light (hereinafter "digital light") in electrophotography.

In a copending application Ser. No. 260,683 filed on the same date as the instant application, the inventor has disclosed a photosensitive member for inputting digital light. The invention of the copending application relates to a photosensitive member having a high $\gamma$ value of a latent image formed on the photosensitive member. In this photosensitive member, avalanche phenomenon of electrons in photosensitive fine crystals is used effectively to make visible the digital input light so as to provide digitally operating electrophotography.

In carrying out into practice the photosensitive member just described, how to increase the sensitivity of the member presents an important problem.

SUMMARY OF THE INVENTION

Therefore it is an object of this invention to provide a novel method of increasing the sensitivity of a photosensitive member having a steep variation in $\gamma$ of a latent image.

Another object of this invention is to provide a method of increasing the sensitivity of a photosensitive member of the type described above so as to obtain clear picture images even when the input signal light is very weak.

According to this invention there is provided a novel method of increasing the sensitivity of a photosensitive member for inputting digital light comprising the steps of preparing a photosensitive member having a steep variation in the value of $\gamma$ of a latent image formed on the photosensitive member, applying digital light to the photosensitive member, and applying another light to the photosensitive member at substantially the same time as the application of the digital light. The other light may be ordinary light, laser light or light emitted by a LED.

DESCRIPTION OF THE PREFERRED EMBODIMENT

Figure 1:
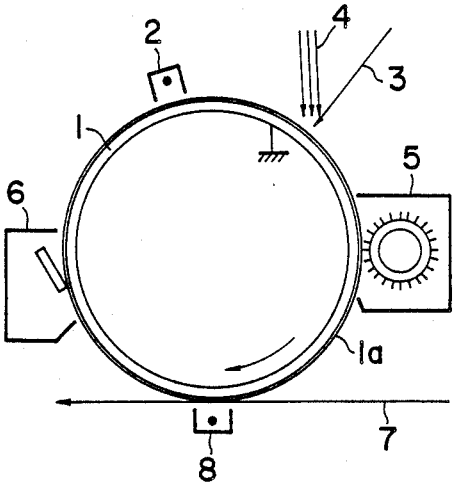
FIG. 1 is a diagrammatic cross-sectional view showing an electrophotographic machine to which the method of this invention is applied.

The electrophotographic machine shown in FIG. 1 comprises a drum 1 around which the photosensitive member 1*a* of the type described above is wound and rotated in the direction of an arrow, a charging unit 2 shown as a corona discharge device, a developing unit 5 wherein a toner is applied to form a developed image, a transfer printing unit 8 for transfer printing the powder image onto a recording medium 7, usually a sheet of paper, and a cleaning unit 6 for removing the toner remaining on the photoconductive member after transfer printing. According to the method of this invention digital light 3 is applied onto the surface of the photosensitive member after charging it with charging unit 2. At substantially the same time another light 4 of uniform intensity is applied or projected onto the photosensitive member for increasing the sensitivity thereof.

One example of the composition of the photosensitive member is as follows.

| | |
|---|---|
| $\alpha$ type phthalocyanine | 10.6 g |
| P-645 (a polyester resin manufactured by Mitsui Toatsu Co.) | 42 g |
| Uban 20-HS (melamine resin manufactured by Mitsui Toatsu Co.) | 9.2 g |
| cyclohexanone | 170 g |

Figure 3:
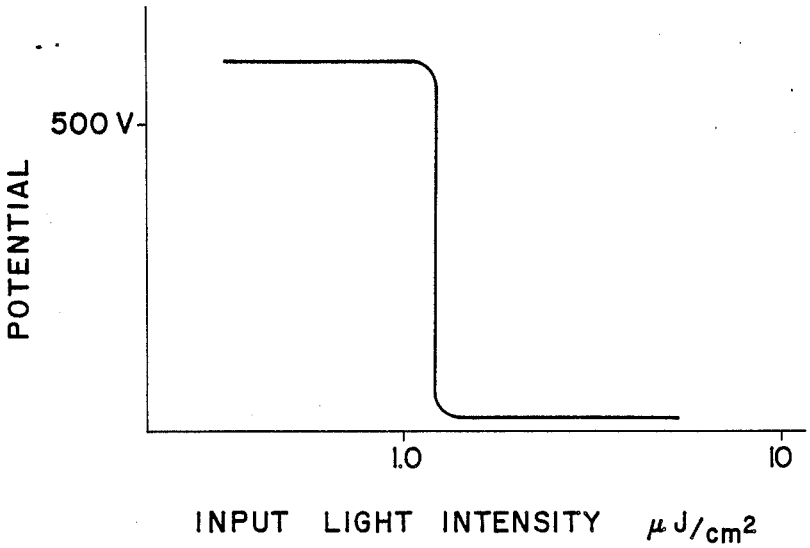
FIG. 3 is a graph showing steep variation in the value of $\gamma$ of a latent image.

All of these components are admixed for 24 hours in a ball mill to form a coating liquid which is coated on the surface of the photosensitive member. The resulting layer is flattened by means shown in FIG. 13 of the copending application No. 260,683, and then heat cured for one hour in an atmosphere maintained at 150° C. to form a photosensitive layer 1*a* having a thickness of 12$\mu$. The photosensitive layer 1*a* has a $\gamma$ characteristic of a latent image as shown in FIG. 3. As shown, $\gamma$ varies steeply at an input light intensity slightly larger than 1.0 $\mu J/cm^2$.

The other light 4 of the uniform intensity is applied for the purpose of increasing the sensitivity of the photosensitive layer la. The other light may be laser light. Preferably, the wavelength of the laser light is the same as the digital light 3, but this is not essential. In a case of a photosensitive layer 1*a* having a $\gamma$ characteristic of the latent image as shown in FIG. 3, where uniform light having an intensity of 1.0 $\mu J/cm^2$is selected, so long as the input signal light has an intensity higher than 0.3 $\mu J/cm^2$, picture images having sufficient intensity can be produced. As the source of the laser light, a solid laser device of the Ga-Sb type is used. However, where it is desired to increase the printing speed or to enlarge the picture, shortage of the light quantity presents a problem. There is an upper limit for the output of the laser device and increase in the laser output results in the increase in the manufacturing cost. Recently, the demand for large size drawings, for example A1 size and A0 size, is increasing. To meet this demand, a complicated electric circuit and light of large intensity must be used.

The method of this invention can effectively solve these problems. Where a photosensitive layer 1*a* having a composition as above described and the $\gamma$ characteristic as shown in FIG. 3 is used, response is possible for a input signal light having an intensity of about 0.3$\mu J/cm^2$. This means that laser light presently used to process drawings of size A4 can process drawings of A0 size at the same processing speed.

Figure 2:
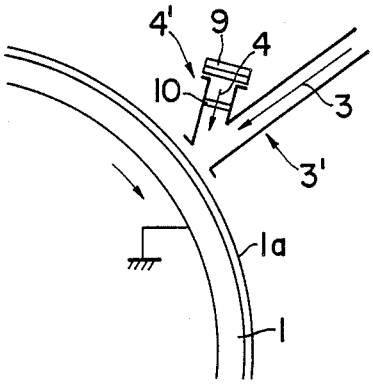
FIG. 2 is a partial sectional view showing the manner of applying an input signal light and another light.

FIG. 2 shows one example of applying the input signal light and the other light having uniform intensity. In FIG. 2, 3' designates a light passage of an input laser light, and 4' designates apparatus for generating and irradiating the other light 4 of uniform intensity. This apparatus comprises a LED luminous plate 9 and a filter 10. If desired, a convex lens can be used. As a light source may be used a fluorescent lamp, an incandescent lamp, etc. In the example shown in FIG. 2, the input signal light and the other light are completely superposed on each other, but it is only necessary that the two lights superpose on each other in a sustaining period of photo current. In other words, the two lights should be applied substantially at the same time.

The input signal light is not limited to laser light and light emitted by LED or other light sources can be used. So long as a steep variation in the $\gamma$characteristic of the latent image can be obtained, the composition of the photosensitive member is not limited to that described above. Where the photosensitive member is constructed such that its $\gamma$ of the latent image is larger than 6 or varies steeply, the sensitivity for a small light quantity becomes small, so that the method of this invention is effective.

The method of this invention is most advantageous where only a weak signal light is available. For example, in a laser beam printer, where it is desirable to obtain a print having a large area such as A0 size, it has been obliged to decrease the printing speed. This is caused by the deficiency of the capacity of the luminous element or the difficulty of precisely maintaining the number of revolutions of a polygonal mirror. However, according to this invention it is not necessary to decrease the printing speed.

As above described, according to this invention, it is possible to respond to weak input signal light to which prior analogue photosensitive members could not respond. For example, even when an output of a LED array or a laser beam which has been used for A4 size is used, reproduction of A0 size is possible.

What is claimed is:

1. A method for increasing the sensitivity to a light signal of a digital photosensitive member which undergoes an avalanche effect when illuminated with light above a threshold intensity level, comprising uniformly illuminating said photosensitive member with light at an intensity level below said threshold level required to trigger said avalanche effect, and illuminating said photosensitive member with said light signal during said uniform illumination, the total intensity of said uniform illumination and said light signal being greater than said threshold level.

2. The method of claim 1 wherein said light signal is a digitally controlled light signal.

3. The method of claim 1 wherein said photosensitive member is uniformly illuminated and illuminated with said light signal through the same light passage.

4. The method of claim 1 wherein said uniform illumination is produced by an incandescent lamp, a LED light source, a laser light source, or a fluorescent lamp.

5. The method of claim 1 wherein said photosensitive member includes a photosensitive layer comprising $\alpha$ type phthalocyanine.

6. The method of claim 5 wherein said photosensitive layer further comprises a polyester resin and a melamine resin.

7. The method of claim 1 wherein said photosensitive member has a $\gamma$ characteristics of a latent image which is greater than 6.

8. A method for increasing the sensitivity to a light signal of a charged digital photosensitive member having a $\gamma$ characteristic of a latent image which is greater the 6, comprising uniformly illuminating said photosensitive member with light at an intensity level below a threshold level required to discharge said photosensitive member, and illuminating said photosensitive member with said light signal during said uniform illumination, the total intensity of said uniform illumination and said light signal being greater than said threshold level.

9. The method of claim 8 wherein said light signal is a digitally controlled light signal.

10. The method of claim 8 wherein said photosensitive member is uniformly illuminated and illuminated with said light signal through the same light passage.

11. The method of claim 8 wherein said uniform illumination is produced by an incandescent lamp, a LED light source, a laser light source, or a fluorescent lamp.

12. The method of claim 8 wherein said photosensitive member includes a photosensitive layer comprising $\alpha$ type phtalocyanine.

13. The method of claim 8 wherein said photosensitive layer further comprises a polyester resin and a melamine resin.

14. An electrophotographic apparatus, comprising a digital photosensitive member which undergoes an avalanche effect when illuminated with light above a threshold intensity level, uniform illumination means for illuminating said photosensitive member with light at an intensity level below said threshold level required to trigger said avalanche effect, and means for illuminating said photosensitive member with a light signal during uniform illumination, the total intensity of said uniform illumination and said light signal being greater than said threshold level.

15. The electrophotographic apparatus of claim 14 wherein said photosensitive member has a $\gamma$ characteristic of a latent image formed thereon which is greater than 6.

16. The electrophotographic apparatus of claim 14 wherein said light signal illuminating means comprises a digitally controlled light source.

17. The elctrophotographic apparatus of claim 14 wherein said uniform illumination means comprises an incandescent lamp, a LED light source, a laser light source, or a fluorescent lamp.

18. The electrophotographic aparatus of claim 14 further comprising a common passageway through which said photosensitive member is illuminated by said uniform illumination means and said light signal illuminating means.

19. The electrophotographic apparatus of claim 14 wherein said photosensitive member includes a photosensitive layer comprising $\alpha$ type phthalocyanine.

20. The electrophotographic apparatus of claim 19 wherein said photosensitive layer further comprises a polyester resin and melamine resin.

21. A method for increasing the sensitivity to a light signal of a digital photosensitive member which undergoes an avalanche effect when illuminated with light above a threshold intensity level, comprising illuminating said photosensitive member with light comprising a first light component at a constant intensity level below said threshold required to trigger said avalanche effect, and a second light component comprising said light signal, the total intensity of said first light component and said second light component being greater than said threshold level.

* * * * *